United States Patent [19]

Light

[11] Patent Number: 5,045,864

[45] Date of Patent: Sep. 3, 1991

[54] INK-RECEIVING TRANSPARENT RECORDING ELEMENTS

[75] Inventor: William A. Light, Victor, N.Y.

[73] Assignee: Eastman Kodak Company, Rochester, N.Y.

[21] Appl. No.: 625,711

[22] Filed: Dec. 3, 1990

[51] Int. Cl.[5] ..... B41M 5/00

[52] U.S. Cl. ..... 346/1.1; 346/135.1; 427/256; 427/261; 428/195; 428/206; 428/323; 428/327; 428/336; 428/480; 428/483; 428/500; 428/914

[58] Field of Search ..... 346/1.1, 135.1; 427/256, 261; 428/336, 195, 206, 323, 327, 480, 483, 500, 914

[56] References Cited

U.S. PATENT DOCUMENTS

| | | | |
|---|---|---|---|
| 3,889,270 | 6/1975 | Hoffman et al. | 346/1.1 |
| 4,264,667 | 4/1981 | Murakami et al. | 428/195 |
| 4,394,442 | 7/1983 | Miller | 430/532 |
| 4,474,859 | 10/1984 | Oshima et al. | 428/481 |
| 4,503,111 | 3/1985 | Jaeger et al. | 428/195 |
| 4,525,419 | 6/1985 | Posey et al. | 428/336 |
| 4,547,405 | 10/1985 | Bedell et al. | 427/256 |
| 4,585,687 | 4/1986 | Posey et al. | 428/195 |
| 4,605,559 | 8/1986 | Nose et al. | 428/332 |
| 4,636,805 | 1/1987 | Toganoh et al. | 346/1.1 |
| 4,664,952 | 5/1987 | Arai et al. | 427/256 |
| 4,686,118 | 8/1987 | Arai et al. | 427/261 |
| 4,722,868 | 2/1988 | Pope | 428/480 |
| 4,801,497 | 1/1989 | Kono et al. | 428/332 |
| 4,824,725 | 8/1989 | Thoese | 428/336 |
| 4,868,581 | 9/1989 | Mouri et al. | 346/1.1 |
| 4,903,039 | 2/1990 | Light | 346/1.1 |
| 4,903,040 | 2/1990 | Light | 346/1.1 |
| 4,903,041 | 2/1990 | Light | 346/1.1 |

FOREIGN PATENT DOCUMENTS

| | | | |
|---|---|---|---|
| 191645 | 8/1986 | European Pat. Off. | 428/195 |

*Primary Examiner*—Pamela R. Schwartz

*Attorney, Agent, or Firm*—Willard G. Montgomery

[57] ABSTRACT

Transparent image-recording elements that contain ink-receptive layers that can be imaged by the application of liquid ink dots. The ink-receptive layers contain a combination of:

(i) a vinyl pyrrolidone:

(ii) particles of a polyester, namely a poly(cyclohexylenedimethylene-co-xylylene terephthalate-co-malonate-co-sodioiminobis(sulfonylbenzoate));

(iii) a homopolymer or a copolymer of an alkylene oxide containing from 2 to 6 carbon atoms;

(iv) a polyvinyl alcohol;

(v) a fluorocarbon surfactant of the formula:

$$CF_3(CF_2)_mCH_2CH_2O—CH_2CH_2O)_nR$$

where m is an integer of 2 through 10, n is an integer of 1 through 18 and R is hydrogen or alkyl of 1 through 10 carbon atoms; and (vi) inert particles.

A printing method which employs the transparent image-recording elements also is described.

17 Claims, No Drawings

INK-RECEIVING TRANSPARENT RECORDING ELEMENTS

FIELD OF THE INVENTION

This invention relates to transparent image-recording elements that contain ink-receptive layers that can be imaged by the application of liquid ink dots. More particularly, this invention relates to transparent image-recording elements that can be imaged by the application of liquid ink dots having ink-receptive layers of enhanced smoothness.

BACKGROUND

Transparent image-recording elements are primarily intended for viewing by transmitted light, for example, observing a projected image from an overhead projector. In a typical application, the viewable image is obtained by applying liquid ink dots to an ink-receptive layer using equipment such as ink jet printers involving either monochrome or multicolor recording.

It is known that the ink-receptive layers in transparent image-recording elements must meet stringent requirements including, an ability to be readily wetted so there is no "puddling", i.e., coalescence of adjacent ink dots that leads to non-uniform densities; an earlier placed dot should be held in place in the layer without "bleeding" into overlapping and latter placed dots; the layer should exhibit the ability to absorb high concentrations of ink so that the applied liquid ink does not run, i.e., there is no "ink run off"; a short ink-drying time, and a minimum of haze. To meet these requirements, the ink-receptive layers of the prior art have been prepared from a wide variety of materials. One class of materials that has been described for use in ink-receptive layers of transparent image-recording elements is the class of vinyl pyrrolidone polymers. Typical patents are as follows:

U.S. Pat. No. 4,741,969, issued May 3, 1988, describes a transparent image-recording element having an ink-receptive layer formed from a mixture of a photopolymerizable, double-bonded anionic synthetic resin and another polymer such as a homo- or copolymer of N-vinyl pyrrolidone. The mixture is cured to provide the ink-receptive layer.

U.S. Pat. No. 4,503,111, issued Mar. 5, 1985, describes a transparent image-recording element for use in ink jet recording and having an ink-receptive layer comprising a mixture of polyvinyl pyrrolidone and a compatible matrix-forming hydrophilic polymer such as gelatin or polyvinyl alcohol.

Unfortunately, transparent image-recording elements that have been described in the prior art and employ vinyl pyrrolidone polymers in ink-receptive layers have generally failed to meet the stringent requirements needed to provide a high quality image and this has significantly restricted their use.

In addition to the requirements already discussed, an important feature of a projection viewable image is the size and nature of the ink dots that form it. In general, a larger dot size (consistent with the image resolution required for a given system) provides higher image density and a more saturated color image and improves projection quality. A known method of increasing dot size involves applying liquid ink dots to a transparent image-receiving sheet, for example, HP PaintJet Film TM (commercially available from Hewlett Packard Company, Palo Alto, Calif.) using an ink jet printer.

The sheet is dried for a short time, for example, 5 minutes, and inserted into a transparent plastic sleeve which protects the sheet and controls development of the dots. The sleeve compresses the dots and their size is increased to provide greater image density and color saturation upon projection of the image. Although this method is effective, it would be desirable to achieve appropriate dot size without the inconvenience of handling a separate sleeve.

In recently issued U.S. Pat. No. 4,903,041, issued Feb. 20, 1990, there is disclosed a transparent image-recording element adapted for use in a printing process in which liquid ink dots are applied to an ink-receptive layer such as an ink jet printing process where liquid ink dots are applied to an ink-receptive layer that contains a vinyl pyrrolidone polymer and particles of a polyester, poly(cyclohexylenedimethylene-co-xylylene terephthalate-co-malonate-co-sodioiminobis(sulfonylbenzoate)), dispersed in the vinyl pyrrolidone to control ink dot size and to provide a high quality projection viewable image. The result is achieved in a simple and expedient manner by varying the concentration of the polyester in the layer as described therein. Such elements constitute a significant advancement in the art by providing transparent image-recording elements which are adapted for use in printing processes where liquid ink dots are applied to an ink-receptive layer in which the ink dot size can be easily controlled. A disadvantage exists, however, with respect to these elements in that the surfaces of the ink-receptive layers on which the liquid ink dots are applied exhibit, after drying, a coarse or roughened texture much like that of very fine sandpaper, so that the surfaces are not smooth or silken to the touch. Although this might not appear at first impression to constitute very much of a problem, it constitutes quite a major problem with respect to potential customer acceptance in that many people who purchase and or work with transparent image-recording elements prefer, if not insist upon, transparent image-recording elements in which the ink-receiving surfaces are smooth or satiny to the touch.

Thus, it would be highly desirable to be able to provide a transparent image-recording element adapted for use in a printing process in which liquid ink dots are applied to an ink-receptive layer, such as an ink jet printing process, which not only possesses all of the benefits and advantages of the transparent image-recording elements disclosed and described in the aforementioned U.S. Pat. No. 4,903,041, including the ability of the ink-receptive layer to control ink dot size and to provide high quality projection viewable images but, in addition, one in which the ink-receptive layer exhibits an enhanced or improved smoothness.

The present invention provides such a transparent image-recording element. The invention also provides a printing process in which liquid ink dots are applied to the ink-receptive layer of the aforementioned element.

SUMMARY OF THE INVENTION

In accordance with the present invention, there is provided a transparent image-recording element that comprises a support and an ink-receptive layer in which the element is adapted for use in a printing process where liquid ink dots are applied to the ink-receptive layer wherein the ink-receptive layer is capable of controlling ink dot size and the surface of which exhibits improved or enhanced smoothness.

DESCRIPTION OF THE PREFERRED EMBODIMENTS

The ink-receptive layers in the novel transparent image-recording elements of this invention preferably comprise (i) from about 15 to 50 percent by weight of a vinyl pyrrolidone polymer, (ii) from about 50 to about 85 percent by weight of a polyester, namely, a poly(cyclohexylenedimethylene-co-xylylene terephthalate-co-malonate-co-sodioiminobis(sulfonylbenzoate)), (iii) from about 1 to about 4 percent by weight of a homopolymer or a copolymer of an alkylene oxide containing from 2 to 6 carbon atoms, (iv) from about 1 to about 4 percent by weight of a polyvinyl alcohol, (v) from about 0.2 to about 1.2 percent by weight of a fluorocarbon surfactant of the formula $CF_3(CF_2)_mCH_2CH_2O—CH_2CH_2O)_nR$ wherein m is an integer of 2 through 10, n is an integer of 1 through 18 and R is hydrogen or alkyl of 1 through 10 carbon atoms and (vi) from about 0.5 to about 1.5 percent by weight of inert particles, all weights being based on the total dry weight of components (i), (ii), (iii), (iv), (v) and (vi). A paticularly preferred ink-receptive layer comprises a vinyl pyrrolidone polymer, a polyester, a homopolymer or a copolymer of an alkylene oxide containing from 2 to 6 carbon atoms, a polyvinyl alcohol, a fluorocarbon surfactant and inert particulate material in a weight ratio of about 1.0:(1.5–3.5):(0.03–0.14):(0.03–0.14):(0.007–0.045):(0.017–0.05). A most preferred ink-receptive layer comprises a vinyl pyrrolidone polymer, a polyester, a homopolymer or copolymer of an alkylene oxide containing from 2 to 6 carbon atoms, a polyvinyl alcohol, a fluorocarbon surfactant and inert particles in a weight ratio of 1:2.3:0.07:0.07:0.02:0.017.

In this way, a transparent image-recording element is made available which is adapted for use in a printing process where liquid ink dots are applied to an ink-receptive layer in which the ink-receptive layer not only is capable of controlling ink dot size but, in addition, possesses an ink-receiving surface of enhanced smoothness.

The present invention is based upon the discovery that the addition to an ink-receptive layer that can be imaged by the application of liquid ink dots containing a highly hydrophilic, highly water-soluble polymer, such as polyvinyl pyrrolidone, and a polyester, specifically a poly(cyclohexylenedimethylene-co-xylylene terephthalate-co-malonate-co-sodioiminobis(sulfonylbenzoate)), used to control ink dot size, of another hydrophilic, but less water-soluble polymer, such as a polyvinyl alcohol, a homopolymer or a copolymer of an alkylene oxide containing from 2 to 6 carbon atoms in the alkylene hydrocarbon group, certain fluorocarbon surfactants and certain inert particles produces a transparent image-recording element adapted for use in a printing process where liquid ink dots are applied to an ink-receptive layer that exhibits not only an ability to easily control ink dot size but, in addition, provides a transparent image-recording element having an ink-receptive layer of improve surface smoothness.

It was not foreseeable that it would be possible to combine the polyvinyl alcohol, the polymerized alkylene oxide monomer(s), the fluorocarbon surfactant and the particulate material of the invention into the coatings or ink-receptive layers containing the polyvinyl pyrrolidone and polyester components to produce a transparent image-recording element that could be adapted for use in a printing process where liquid ink dots are applied to an ink-receptive layer where the ink-receptive layer not only was still capable of controlling ink dot size without interference or disruption due to the inclusion of the additional polyvinyl alcohol, polymerized alkylene oxide monomer(s), fluorocarbon surfactant and inert particulate components into the ink-receptive layer but one in which the ink-receiving surface exhibited a smooth, glassy texture so important to customer acceptance.

In addition, it is deemed or believed that the enhanced smoothness exhibited by the ink-receiving surfaces of the novel transparent image-recording elements of the present invention also is an indication that the ink-receptive layers of the invention possess improved slipperiness, improved anti-blocking characteristics or properties particularly under conditions of high temperature and high humidity, improved resistance to sticking in printing and improved adhesion or resistance to rub-off of the image produced on the ink-receptive surface.

The ink-receptive layer in the novel transparent image-recording elements of this invention contains a vinyl pyrrolidone polymer. Such polymers and their use in ink-receptive layers of the type disclosed herein are well known to those skilled in the art and include homopolymers of vinyl pyrrolidone, as well as copolymers thereof with other polymerizable monomers. Useful materials include polyvinyl pyrrolidone, and copolymers of vinyl pyrrolidone with copolymerizable monomers such as vinyl acetate, methyl acrylate, methyl methacrylate, ethyl acrylate, ethyl methacrylate, butyl acrylate, butyl methacrylate, methyl acrylamide, methyl methacrylamide and vinyl chloride. Typically, the polymers have viscosity average molecular weights ($M_v$) in the range of about 10,000 to 1,000,000, often about 300,000 to 850,000. Such polymers are typically soluble in aqueous media and can be conveniently coated from such media. A wide variety of the vinyl pyrrolidone polymers are commercially available and/or are disclosed in a number of U.S. Patents including U.S. Pat. Nos. 4,741,969; 4,503,111; 4,555,437 and 4,578,285. The concentration of the vinyl pyrrolidone polymer in the ink-receptive layer is subject to some variation. It is used in sufficient concentration to absorb or mordant the printing ink in the layer. A useful concentration is generally in the range of about 15 to about 50 percent by weight based on the total dry weight of the layer although concentrations somewhat in excess of about 50 weight percent and concentrations somewhat below about 15 weight percent may be used in the practice of the present invention.

The polyesters in the elements of this invention are poly(cyclohexylenedimethylene-co-xylylene terephthalate-co-malonate-co-sodioiminobis(sulfonylbenzoates)). A specific polyester useful in the practice of this invention is poly(1,4-cyclohexanedimethylene-co-p-xylylene (40/60) terephthalate-co-malonate-co-3,3'-sodioiminobis(sulfonylbenzoate) (45/40/15). The numbers immediately following the monomers refer to mole ratios of the respective diol and acid components. Useful polyesters are known in the prior art and procedures for their preparation are described, for example, in U.S. Pat. No. 3,546,180, issued Dec. 8, 1970, the disclosure of which is hereby incorporated herein by reference. The polyesters are linear condensation products formed from two diols, i.e., cyclohexanedimethanol and xylylene glycol and three diacids, i.e., terephthalic acid, malonic acid, and sodioiminobis(sulfonyl benzoic acid)

and/or their ester-forming equivalents. Such polyesters are dispersible in water or aqueous media and can be readily coated from such media. In general, such polyesters have an inherent viscosity of at least 0.1, often about 0.1 to 0.7 measured in a 50/50 parts, by weight, solution of phenol/chlorobenzene at 25° C. and at a concentration of about 0.25 g of polymer in 1 deciliter of solvent.

The polyesters, along with the inert particles of the present invention which are discussed in detail below, are in the form of dispersed particles within a mixture of the vinyl pyrrolidone polymer, the polyvinyl alcohol, the polymerized alkylene oxide monomer(s) and the fluorocarbon surfactant components of the present invention. The particles of polyester generally have a diameter of up to about 1 micrometer, often about 0.001 to 0.1 and typically 0.01 to 0.08 micrometer. The size of the polyester particles in a layer is, of course, compatible with the transparency requirements for a given situation. The concentration of the polyester in the ink-receptive layer also is subject to variation. A useful concentration is generally in the range of from about 50 to about 85 percent by weight based on the total dry weight of the layer. In general, concentrations of polyester significantly in excess of about 85 weight percent should be avoid as they tend to undesirably increase ink-drying time and decrease image resolution due to the tendency of adjacent ink droplets to flow together, while concentrations of polyester which are significantly less than about 50 weight percent also should be avoided as they tend to adversely affect projection image quality by producing ink dots of such small size that image density is low.

The hydrophilic polyvinyl alcohol component of the ink-receptive layer compositions of the present invention must be soluble in water at elevated temperature and insoluble, but swellable, by water at room temperature. "Room temperature" is the temperature range normal in human living and working environments and is generally considered to be between about 15° C. and 35° C.

The composition of polyvinyl alcohol does appear to be broadly critical. If essentially fully hydrolyzed types are used, the polyvinyl alcohol should have a number average molecular weight below about 60,000 to obtain a transparent coating. Fully hydrolyzed polyvinyl alcohols having number average molecular weights of approximately 40,000 are particularly useful in the ink-receptive layer compositions of the present invention. Polyvinyl alcohols that are less than fully hydrolyzed, and thus have a greater percentage of acetate substitution, can be of a higher molecular weight. For example, excellent ink receptivity, drying times and transparency are obtained with a 98% hydrolyzed polyvinyl alcohol of 60,000 nominal number average molecular weight.

The reason for the broad limitations on the nature of the polyvinyl alcohol lies in the nature of the film which they may produce. The films rapidly lose transparency as the number average molecular weight increases above the 60,000 range for a fully hydrolyzed polyvinyl alcohol.

A useful concentration of the polyvinyl alcohol in the ink-receptive layer is generally in the range of about 1 to about 4 percent by weight based on the total dry weight of the layer. Although concentrations of polyvinyl alcohol somewhat in excess of about 4 weight percent and somewhat below about 1 weight percent can be used in the practice of the present invention, concentrations significantly in excess of about 4 weight percent should be avoided as they tend to cause the layer or film to lose transparency and become hazy, while concentrations significantly below about 1 weight percent also should be avoided as they tend to cause increased roughness of the ink-receiving surface of the ink-receptive layer which, of course, circumvents the objective of the present invention.

The polymerized alkylene oxide components of the ink-receptive layer compositions of the present invention constitute nonionic surface active polymers including homopolymers and copolymers of an alkylene oxide in which alkylene refers to divalent hydrocarbon groups having 2 to 6 carbon atoms such as ethylene, propylene, butylene and the like. Generally, the commercial forms of the alkylene oxides are employed. For example, the commercial form of propylene oxide is 1,2-propylene oxide and not the 1,3-form. The above-mentioned alkylene oxides can be polymerized or mixtures thereof can be copolymerized by well-known methods such as by heating the oxide in the presence of an appropriate catalyst such as a mixture of aluminum hydride and a metal acetylacetone as taught in U.S. Pat. No. 3,375,207, issued Mar. 26, 1968, to form stereospecific long-chain compounds characterized by high molecular weights of from about 100,000 to 5,000,000 weight average molecular weight. The polymerized alkylene oxide components of the ink-receptive layers of the present invention in combination with the polyvinyl alcohol, the fluorocarbon surfactant and the inert particulate components of the invention are believed to play a role in imparting an enhanced smoothness to the ink-receiving surfaces of the ink-receptive layers of the recording elements of the invention. That is, all three components together are believed to contribute towards the achievement of an ink-receptive layer of enhanced smoothness. Although polymerized alkylene oxides having weight average molecular weights both above 5,000,000 and below 100,000 can be used in the practice of the present invention, caution should be exercised in selecting a polymerized alkylene oxide or mixture of polymerized alkylene oxides the molecular weights of which are so far below 100,000 that ink-drying time is undesirably prolonged.

A useful concentration of the polymerized alkylene oxide component in the ink-receptive layer is generally in the range of about 1 to about 4 percent by weight based on the total dry weight of the layer, although concentrations somewhat in excess of about 4 weight percent and somewhat below about 1 weight percent can be used in the practice of the present invention without adversely affecting the smoothness of the ink-receptive layer.

The fluorocarbon surfactant component of the ink-receptive layer compositions of the present invention is incorporated into the layer to contribute in part to providing an ink-receiving surface having enhanced smoothness and to improve the dispersion properties of the layer to facilitate the application or coating of the layer onto the support.

The fluorocarbon surfactants employed in the ink-receptive layer compositions of the present invention are those fluorocarbon surfactants having the structure:

$$CF_3(CF_2)_mCH_2CH_2O—CH_2CH_2O)_nR$$

where m=2–10;

n=1-18, and

R is hydrogen or alkyl of 1 through 10 carbon atoms.

Especially preferred fluorocarbon surfactants are those having the formula:

$$CF_3(CF_2)_mCH_2CH_2CH_2O—CH_2CH_2O)_nR$$

where m=2-10;

n=5-14, and

R=H.

These surfactants are available commercially from E. I. du Pont de Nemours and Company as Zonyl ®FSN and FC-170C available from the 3M Company. Particularly preferred fluorocarbon surfactants are perfluoroalkyl ethoxylates of the formula:

$$CF_3(CF_2)_6CH_2CH_2O—CH_2CH_2O)_{13-14}H.$$

The concentration of the fluorocarbon surfactant component in the ink-receptive layer typically is in the range of about 0.2 to about 1.2 percent by weight based on the total dry weight of the layer. Although concentrations somewhat in excess of about 1.2 weight percent may be used in the practice of the present invention, amounts greatly exceeding about 1.2 weight percent are to be avoided since there is a gradual tendency for concentrations progressively exceeding about 1.2 weight percent to cause "image drawback" where ink dots on the ink-receptive layer tend to be dense in the center and lighter around the edges.

The ink-receptive layer also includes inert particulate material. Such materials also are believed to aid in enhancing the smoothness characteristics of the ink-receptive surfaces of the image-recording elements of the invention, particularly after they have been printed on without adversely affecting the transparent characteristics of the element. Suitable particulate material includes inorganic inert particles such as chalk, heavy calcium carbonate, calcium carbonate fine, basic magnesium carbonate, dolomite, kaolin, calsined clay, pyrophyllite, bentonite, scricite, zeolite, talc, synthetic aluminum silicate, synthetic calcium silicate, diatomaceous earth, anhydrous silic acid fine powder, aluminum hydroxide, barite, precipitated barium sulfate, natural gypsum, gypsum, calcium sulfite and organic inert particles such as polymeric beads including polymethyl methacrylate beads, copoly(methyl methacrylate-divinylbenzene) beads polystyrene beads and copoly(vinyltoluene-t-butylstyrene-methacrylic acid) beads. The composition and particle size of the inert particulate material is selected so as not to impair the transparent nature of the image-receiving element. Typically, inert material having an average particle size not exceeding about 25, and preferably less than 12, for example, 3-12 microns are used in the practice of the present invention. When the particle size is not less than about 25 microns, the resulting surface of the ink-receptive layer exhibits increased roughness due to the coarse projections of the particles. On the other hand, when the particle size is less than about 3.0 microns, it is necessary to use a large amount of inert particles to aid in achieving the desired smoothness of the ink-receptive layer surface. Generally, the ink-receptive layer will contain from about 0.5 to 1.5 percent by weight, and preferably from about 0.8 to 1.2 percent by weight, based on the total dry weight of the layer, of the inert particulate material. Concentrations in amounts in excess of about 1.5 weight percent and less than about 0.5 weight percent may used in the practice of the present invention, however, caution should be exercised not to use concentrations significantly greater than about 1.5 weight percent so that the optical characteristics of the element remain unimpaired and hazing of the element does not occur. It is also prudent to exercise caution in using concentrations of particulate materials significantly lower than about 0.5 weight percent so that blocking or sticking of the elements is to each other to other other materials does not occur. $SiO_2$ and copoly(methyl methacrylate-divinylbenzene) are preferred inert particles for use in the present invention.

The image-recording elements of this invention comprise a support for the ink-receptive layer. A wide variety of such supports are known and commonly employed in the art. They include, for example, those supports used in the manufacture of photographic films including cellulose esters such as cellulose triacetate, cellulose acetate propionate or cellulose acetate butyrate, polyesters such as poly(ethylene terephthalate), polyamides, polycarbonates, polyimides, polyolefins, poly(vinyl acetals), polyethers and polysulfonamides. Polyester film supports, and especially poly(ethylene terephthalate) are preferred because of their excellent dimensional stability characteristics. When such a polyester is used as the support material, a subbing layer is advantageously employed to improve the bonding of the ink-receptive layer to the support. Useful subbing compositions for this purpose are well known in the photographic art and include, for example, polymers of vinylidene chloride such as vinylene chloride/acrylonitrile/acrylic acid terpolymers or vinylidene chloride/-methyl acrylate/itaconic acid terpolymers.

The ink-receptive layers are coated from aqueous dispersions comprising the vinyl pyrrolidone polymer, the polyvinyl alcohol, the polymerized alkaline oxide monomer(s), and the fluorocarbon surfactant in solution in the aqueous medium having solid particles of the polyester and the inert particulate material dispersed therein. For example, the dispersion can be prepared by admixing the polyester and the inert particulate material in an aqueous medium containing the fluorocarbon surfactant and heating the aqueous dispersion thus formed to about 88° C. for about 2 to 6 hours, preferably about 4 hours, then adding an aqueous solution of the vinyl pyrrolidone polymer and an aqueous solution of the polyalkylene oxide to the aqueous polyester-containing dispersion while the aqueous polyester-containing dispersion is still hot or, alternatively, after it has been cooled to room temperature. Next, an aqueous solution of the polyvinyl alcohol component formed by dissolving a suitable solid polyvinyl alcohol in an aqueous medium while heating and stirring at a temperature, typically about 100° C., and for a time, typically 30 to 90 minutes, sufficient to dissolve the solid polyvinyl alcohol in the aqueous medium is added to the polyester-containing dispersion while the aqueous solution of the polyvinyl alcohol is still hot or, alternatively, after it has been cooled to room temperature. As an alternative mode of preparation, a dispersion can be prepared by admixing the polyester in an aqueous medium containing the fluorocarbon surfactant and heating the aqueous dispersion thus formed to about 88° C. for about 2 to 6 hours, preferably about 4 hours and then adding solid vinyl pyrrolidone polymer and solid polyalkylene oxide to the aqueous polyester-containing dispersion after cooling the aqueous polyester-containing dispersion to room temperature followed by the addition of an aqueous solution of the polyvinyl alcohol and the inert particulate material. Such dispersions are coated as a thin layer on the support and dried. The dispersion can be coated on the support by any of a number of suitable procedures including immersion or dip coating, roll coating, reverse roll coating, air knife coating, doctor blade coating and bead coating. The thickness of the ink-receptive layer can be varied widely. The thickness of an ink-receptive layer imaged by liquid ink dots in an ink jet recording method is typically in the range of about 4.0 to about 25 microns, and often in the range of about 8.0 to about 16 microns, dry thickness.

The transparent image-recording elements of this invention are employed in printing processes where liquid ink dots are applied to the ink-receptive layer of the element. A typical process is an ink-jet printing process which involves a method of forming type characters on a paper by ejecting ink droplets from a print head from one or more nozzles. Several schemes are utilized to control the deposition of the ink droplets on the image-recording element to form the desired ink dot pattern. For example, one method comprises deflecting electrically charged ink droplets by electrostatic means. Another method comprises the ejection of single droplets under the control of a piezoelectric device. Such methods are well known in the prior art and are described in a number of patents including, for example, U.S. Pat. Nos. 4,636,805 and 4,578,285.

The inks used to image the transparent image-recording elements of this invention are well known for this purpose. The ink compositions used in such printing processes as ink-jet printing are typically liquid compositions comprising a solvent or carrier liquid, dyes or pigments, humectants, organic solvents, detergents, thickeners, preservatives, and the like. The solvent or carrier liquid can be predominantly water, although ink in which organic materials such as polyhydric alcohols, are the predominant carrier or solvent liquid also are used. The dyes used in such compositions are typically water-soluble direct or acid type dyes. Such liquid ink compositions have been extensively described in the prior art including, for example, U.S. Pat. Nos. 4,381,946, issued May 3, 1983; 4,386,961, issued Jun. 7, 1983; 4,239,543, issued Dec. 16, 1980; 4,176,361, issued Nov. 27, 1979; 4,620,876, issued Nov. 4, 1986; and 4,781,758, issued Nov. 1, 1988.

The invention has been described in detail with particular reference to preferred embodiments thereof, but it will be understood that variations and modifications can be effected within the spirit and scope of the invention.

I claim:

1. A transparent image-recording element comprising a support and an ink-receptive layer in which the element is adapted for use in a printing process where liquid ink dots are applied to the ink-receptive layer wherein the ink-receptive layer is capable of controlling ink dot size and the surface of which exhibits improved or enhanced smoothness, said ink-receptive layer comprising:

(i) a vinyl pyrrolidone;

(ii) particles of a polyester which is a poly(cyclohexylenedimethylene-co-xylylene terephthalate-co-malonate-co-sodioiminobis(sulfonylbenzoate));

(iii) a homopolymer or a copolymer of an alkylene oxide containing from 2 to 6 carbon atoms;

(iv) a polyvinyl alcohol;

(v) a fluorocarbon surfactant of the formula:

$$CF_3(CF_2)_mCH_2CH_2O—CH_2CH_2O)_nR$$

wherein m is an integer of 2 through 10, n is an integer of 1 through 18 and R is hydrogen or alkyl of 1 through 10 carbon atoms, and (vi) inert particles.

2. A transparent image-recording element of claim 1 wherein said polyester and said inert particles are dispersed in a mixture of (i), (iii), (iv) and (v).

3. The element of claim 1 wherein said ink-receptive layer comprises from about 15 to about 50 percent by weight of said polyvinyl pyrrolidone polymer, from about 50 to 85 percent by weight of said polyester, from about 1 to 4 percent by weight of said homopolymer or copolymer of alkylene oxide, from about 1 to about 4 percent by weight of said polyvinyl alcohol, from about 0.02 to about 1.2 percent by weight of said fluorocarbon surfactant and from about 0.5 to about 1.5 percent by weight of said inert particles, all weights based on the total dry weight of components (i), (ii), (iii), (iv), (v), and (vi).

4. The element of claim 1 wherein said ink-receptive layer comprises said vinyl pyrrolidone polymer, said polyester, said homopolymer or copolymer of alkylene oxide, said polyvinyl alcohol, said fluorocarbon surfactant and said inert particles in a weight ratio of about 1.0:(1.5–3.5):(0.03–0.14):(0.03–0.14):(0.007–0.045):(0.0-17–0.05).

5. The element of claim 1 wherein said ink-receptive layer is about 4.0 to 25 microns thick.

6. The element of claim 1 wherein said polyester particles have a diameter up to about 1.0 micrometer.

7. The element of claim 6 wherein said polyester is poly(1,4-cyclohexylenedimethylene-co-p-xylylene (40/60) terephthalate-co-malonate-co-3,3'-sodioiminobis(sulfonylbenzoate)) (45/40/15).

8. The element of claim 1 wherein said inert particles have a diameter of from about 3.0 to about 25 microns.

9. The element of claim 8 wherein said inert particles are particles of $SiO_2$.

10. The element of claim 8 wherein said inert particles are particles of copoly(methyl methacrylate-divinylbenzene).

11. The element of claim 1 wherein said polyvinyl alcohol is a partially hydrolyzed polyvinyl alcohol.

12. The element of claim 11 wherein said polyvinyl alcohol has a number average molecular weight of at least 60,000.

13. The element of claim 1 wherein said fluorocarbon surfactant is a fluorocarbon surfactant having the formula:

$$CF_3(CF_2)_mCH_2CH_2O—CH_2CH_2O)_nR$$

wherein m is an integer of 2 through 10, n is an integer of 5 through 14 and R is hydrogen.

14. The element of claim 13 wherein said fluorocarbon surfactant is a fluorocarbon surfactant having the formula:

$$CF_3(CF_2)_6CH_2CH_2O—CH_2CH_2O)_{13-14}H.$$

15. The element of claim 1 wherein the ink-receptive layer is on a polyester film support.

16. The element of claim 15 wherein the polyester is poly(ethylene terephthalate).

17. A printing process in which liquid ink dots are applied to an ink-receptive layer of a transparent image-recording element wherein the element is the element of claim 1.

* * * * *